United States Patent [19]

Hyde

[11] Patent Number: 4,457,233

[45] Date of Patent: Jul. 3, 1984

[54] AERIAL BOMB

[76] Inventor: Marshall Hyde, 1344 Griswold, Port Huron, Mich. 48060

[21] Appl. No.: 427,526

[22] Filed: Sep. 29, 1982

[51] Int. Cl.[3] ..... F42B 7/00

[52] U.S. Cl. ..... 102/346; 102/430

[58] Field of Search ..... 102/430, 448, 449, 462, 102/463, 464, 465, 466, 501, 502, 346, 357

[56] References Cited

U.S. PATENT DOCUMENTS

| | | | |
|---|---|---|---|
| 535,384 | 3/1895 | Lower | 102/462 |
| 1,605,655 | 11/1926 | Du Pont | 102/466 |
| 3,062,144 | 11/1962 | Hori et al. . | |
| 3,215,075 | 11/1965 | Bayard et al. | 102/42 R |
| 3,323,456 | 6/1967 | Rothman | 102/346 |
| 3,349,707 | 10/1967 | Wortley, Jr. et al. | 102/346 |
| 3,596,599 | 8/1971 | Schillreff | 102/37.6 |
| 3,601,053 | 8/1971 | Grall | 102/37.6 |
| 3,760,729 | 9/1973 | Freeman | 102/37.6 |
| 3,906,859 | 9/1975 | Smith | 102/444 |

FOREIGN PATENT DOCUMENTS

| | | | |
|---|---|---|---|
| 1101222 | 1/1955 | Fed. Rep. of Germany | 102/38 PP |
| 28369 | of 1898 | United Kingdom | 102/448 |

OTHER PUBLICATIONS

"The Shotgun Shell of the Future", by Hall et al., Guns and Ammo, Apr. 1967, pp. 1–4.

*Primary Examiner*—Harold J. Tudor
*Assistant Examiner*—Tyrone Davis
*Attorney, Agent, or Firm*—Harness, Dickey & Pierce

[57] ABSTRACT

A new aerial bomb for uses such as scaring birds and other such creatures away from airport runways, farmer's fields, and the like, is disclsoed. When detonated in a shotgun, the aerial bomb provides two reports; the first occurring when the propelling powder in the shotgun shell is ignited, and the second occuring when the ignited projectile bomb explodes several seconds later. A unique fuse is provided such that no physical connection is necessary in the shotgun shell between the propellant powder and the explosive projectile fuse. Furthermore, the casing of the shell is provided with visual observation means and the projectile is provided with position indicator means, so that the fully assembled aerial bomb may be readily inspected to verify proper installation of the projectile in the casing.

1 Claim, 4 Drawing Figures

AERIAL BOMB

BACKGROUND AND SUMMARY OF THE INVENTION

The present invention pertains primarily to aerial bombs and more particularly to aerial bombs of the time delay type which may be shot from a shotgun, for example.

Aerial bombs of the general type to which the present invention pertains are known in the art and embody a variety of structures. Typically, such prior art devices comprise in part what is essentially a firecracker or projectile with an attached fuse. The fuse extends from the base of the projectile through a washer or wad to a percussion element or mass of propellant charge, with all of the above elements packed in a conventional shotgun shell. When the percussion cap or primer on the shotgun shell base is detonated, the percussion element or propellant charge is ignited and in turn ignites the fuse on the firecracker or projectile. The projectile is propelled out of the shotgun shell casing and explodes a few seconds later at a location away from the original shotgun shell detonation.

Such aerial bombs may be used to remove birds or other animals from an area without subjecting the animals to any substantial risk of harm. Such birds or other animals are hopefully scared away from the area by the explosion of the firecracker or projectile and flee for safety, thus ridding an airplane pilot or a farmer, for example, of annoying or even dangerous pests.

Many of the prior devices of the type described suffer from a number of shortcomings. Such devices are frequently relatively complicated in construction, expensive to manufacture, and require precise positioning of a relatively large number of parts. The typical ignition fuse of the previously known devices extends longitudinally from the base of the projectile like a firecracker fuse and is often damaged in manufacture or assembly so as to cause a potential danger of premature explosion within the barrel of the shotgun or short bursts outside the barrel. The lack of uniformity in the fuse extensions also detracts from the desired uniform timing of the aerial bomb explosion. The prior art washers or wads are typically made of relatively heavy or rigid materials which suffer from significant resistance during travel through the shotgun barrel. Also, if the projectile itself is too large, it too may experience excessive barrel resistance and a consequent presssure build-up in the barrel which may cause premature explosion. Finally, if the projectile is improperly installed during assembly with the means incorrectly oriented at the wrong end of the casing the projectile will not explode after being propelled from the shotgun barrel.

Accordingly, it is an object of the present invention to provide an improved aerial bomb that is less complicated to properly construct and assemble than the prior art devices, thereby providing additional assurance of proper and uniform firing and providing additional protection against wad or projectile obstructions, barrel explosions, or short bursts.

In general, an aerial bomb according to the present invention comprises a shotgun shell hull or casing, a base for the shotgun shell hull enclosing one end thereof, and a shotshell primer. A mass of propellant powder is disposed in the shotgun shell hull adjacent the base and is in contact with the shotshell primer. An annular, wad packed adjcent the propellant powder charge, has a diameter sufficient to maintain continuous peripheral contact with the adjacent inner surface of the shotgun shell casing and includes an opening extending therethrough. A projectile located inside the shotgun shell hull includes a tube having two open ends and a diameter sufficiently smaller than the inner diameter of the shotgun shell casing to prevent continuous peripheral contact between the tube and the casing. The projectile further includes a fuse packed in the end of the tube communicating with the wad, an explosive charge within the tube, and a cap or other closure means on the opposite end of the tube. The end of the shotgun shell casing opposite the base is releasably closed to retain its contents until initial firing in the shotgun.

Upon initial firing hot gases from the ignited propellant powder pass through the hole in the wad to ignite the projectile fuse. The projectile is thereby expelled from the shotgun shell casing and the barrel and explodes several seconds later. Both the initial explosion and the delayed explosion may be used to frighten away undesirable birds or other animals without subjecting them to significant risk of harm.

According to the invention, the hull or casing of the aerial bomb includes means for permitting visual observation of position indicator means located on the projectile inside the casing. Such visual observation means allows quick and convenient inspection of one or more assembled aerial bomb devices to determine whether the projectile has been properly installd in the casing. In the preferred embodiment, the casing is composed of a substantially transparent, semi-transparent or translucent material, and the cap of the projectile has a color that contrasts with the remainder of the projectile, or at least contrasts with the fuse end of the projectile. Thus, by merely looking through the closed end of the casing, one may readily determine whether the cap end of the preferred projectile is properly positioned at the closed end of the casing and accordingly, that the projectile fuse is positioned adjacent the base end of the casing.

Additional advantages and features of the present invention will become apparent from the following description and the appended claims taken in conjunction with the accompanying drawings.

DETAILED DESCRIPTION OF THE PREFERRED EMBODIMENTS

Figure 1:
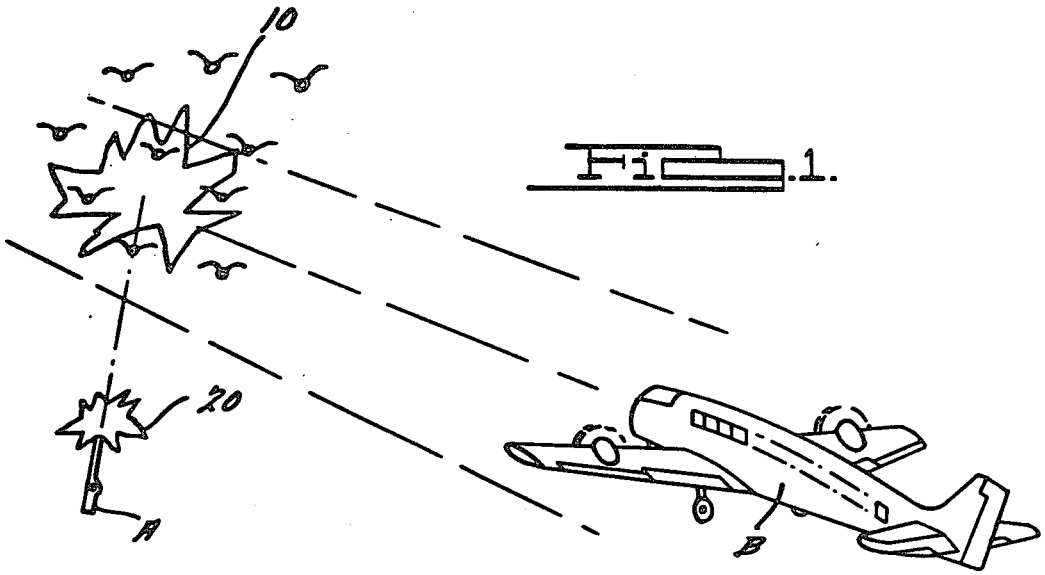
FIG. 1 is a perspective view of an airport runway showing the aerial bomb of the present invention to use to scare away birds.

FIGS. 1 through 4 of the drawings depict an exemplary embodiment of the invention for purposes of illustration. One skilled in the art will readily recognize from the following discussion, however, that the principles of the invention are equally applicable to ammunition devices of other types and configurations other than that shown in the drawings and that the illustrated embodiment has other uses and applications than that shown in the drawings.

FIG. 1 shows one contemplated use of the aerial bomb of the present invention, in which birds are being scared away from an airport runway in order to alleviate a potential hazard to aircraft using the runway. Other possible applications include use by farmers to scare away birds, rodents, and the like from crops, trees, etc., as well as use for providing a loud signal capable of being heard or received at a distant point. Although the schematically-illustrated delayed explosion 10 of the projectile is preferably the greatest, a smaller first explosion 20 is also provided from the shotgun A when the projectile is expelled from a shotgun shell hull or casing. The two reports or explosions thus provide additional chance of scaring away the undesirable birds to provide the airplane B with a clear and safe runway.

Figure 2:
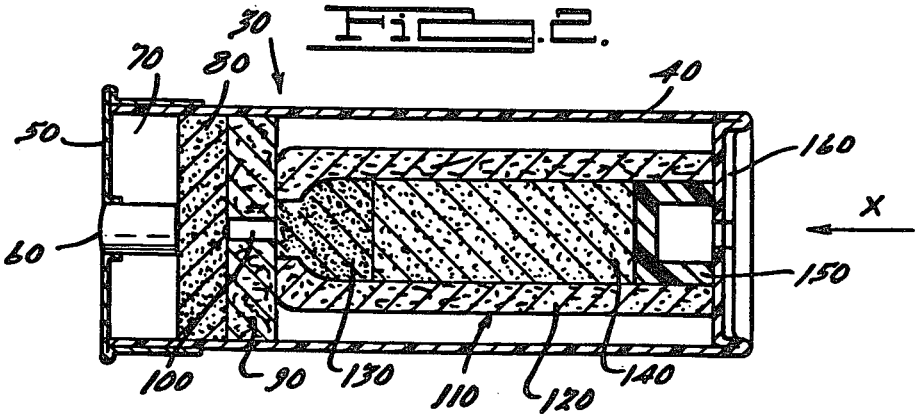
FIG. 2 is a longitudinal sectional view of the aerial bomb of the present invention.

As best shown in FIG. 2, an aerial bomb 30 of the present invention includes a shotgun shell hull or casing 40 that is preferably tubular in shape and composed of a substantially transparent, semi-transparent, or even a translucent material, such as plastic, for example. A base 50 is attached at one end of the casing 40 and encloses the casing entirely. The base 50 may be made of metal, as is typical in the industry, and the casing 40 is secured inside the upper flange of the base to protrude outwardly therefrom. A shotshell primer 60 is provided in the center of the base 50 and is contacted by the firing pin of the shotgun when the trigger is pulled. An annular plug 70 is typically packed around the primer charge. The shotgun shell hull 40, the base 50, and the shotshell primer 60, shown for purposes of illustration in FIG. 2, are typical and well-known in the art and may be made from any of several known materials and gauge sizes.

A mass of propellant powder 80 is disposed adjacent the base 50, in contact with the shotshell primer 60. Approximately 10 to 15 grains of smokeless powder per shell has proven satisfactory, although the exact quantity is determinable according to principles well-known to those skilled in the art. The smokeless powder may be made of nitro-cellulose, metallic nitrate, and other known fillers, but preferably should have ballistic properties comparable to those of black powder.

Packed on top of the propellant powder 80 is an annular wad 90. A cardboard or plastic wad approximately 0.100 to 0.150 inches thick has been satisfactory. The wad 90 has a hole 100 approximately 0.0625 inches in diameter extending through its center to function as a pathway for hot gases from the ignited propellant charge 80. Since the wad is preferably symmetrical, it is reversible and can be inserted either side up thereby simplifying automatic production. The wad 90 is of a diameter just slightly less than that of the inner surface of the shotgun shell hull 40 to provide a tight, sliding fit so that continuous peripheral contact is maintained to seal with the adjacent inner surface of the hull. If the wad does not seal properly, hot gases may escape around the periphery of the wad rather than through the hole 100, thereby lessening the uniformity of firing and projectile ignition.

A projectile 110 is provided inside the shotgun shell hull or case 40 and preferably comprises a hard, i.e., relatively rigid, cardboard or other cylindrical tube 120 having two ends. It has been found that using a projectile approximately 15 mm in diameter and 40 mm in length to fit in a barrel (and shotgun shell casing) approximately 19 mm in diameter (for a 12 gauge shotgun) provides a sufficiently loose fit to prevent dangerous pressure build-up in the shotgun barrel in the event of premature explosion.

The projectile 110 comprises a tightly packed fuse 130 on the end of the tube 120, which must be oriented toward the wad 90 so that the fuse 130 may be ignited by the hot gases produced by the initial ignition of the propellant powder 80. Any suitable fuse mixture such as compacted black powder, possibly including an inert filler, may be used. The tube 120 may be crimped or otherwise formed to retain the fuse 130 therein. An explosive powder charge 140, preferably including a material such as a mixture of powdered aluminum and potassium perchlorate, for example, is packed inside the projectile tube 120 adjacent the fuse 130. Approximately 18 grains of explosive powder charge has been found to be satisfactory. A closure means, which is preferably a plastic cap or plug 150, seals the opposite open end of the projectile and is oriented toward the opposite end of the casing from the base 50.

Once the packed projectile 110 is slipped inside the shotgun shell hull or casing 40 during assembly of the aerial bomb of the present invention, the open end of the casing opposite the base 50 may be crimped or closed by any suitable means. If the casing 40 is long enough, a star-crimp type closure 160, such as that shown in FIGS. 3 and 4, may be made so that the end of the casing 40 is folded into itself to close off the end of the casing.

Figure 3:
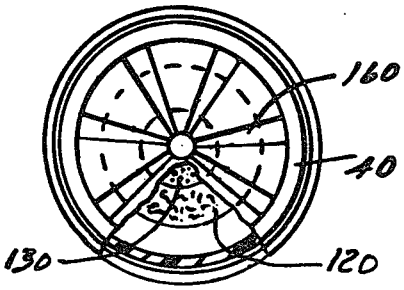
FIG. 3 is an end view of the aerial bomb of FIG. 2, looking in the direction indicated by the arrow X, with an improperly installed projectile therein.
Figure 4:
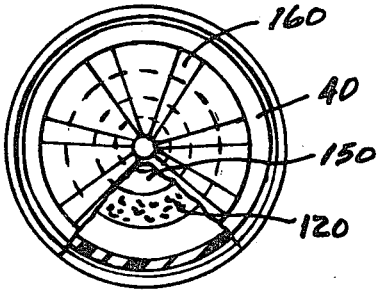
FIG. 4 is an end view, similar to FIG. 3, but with a readily identifiable, properly installed projectile therein.

The projectile 110 must be installed in a proper orientation in the casing 40, with its fuse 130 generally adjacent to, and in communication with, the wad 90. If the projectile is improperly installed in the casing, as illustrated in FIG. 3, with its fuse end oriented toward the outer end of the casing, the projectile may not explode after being expelled from the shotgun upon firing. Thus, in order to function properly as a delayed-explosion, dual-report, aerial bomb the aerial bomb 30 must be assembled as shown in FIG. 4, with the fuse end of the projectile at the base end of the casing so that the projectile fuse 130 may be ignited by the hot gases flowing through the hole 100 in the wad 90.

Once the projectile has been inserted in the casing 40 and the outer end of the casing has been crimped or otherwise closed, it is difficult to inspect one or a group of the aerial bombs to determine whether the projectile was properly installed in the desired orientation. Such difficulty may be experienced even with the conventional substantially transparent or semi-transparent casings, which are preferred for aerial bomb applications, because the crimping or other means of closing the outer end of the casing typically tends to distort or "fog" the casing material at the outer end. Such distortion or fogging of the outer casing end typically obscures visual observation of the outer end of the projectile, thus making it very difficult to determine whether one is observing the fuse end or the cap end of the projectile.

In order to make inspection of the aerial bomb more quick and convenient to accomplish, the preferred embodiment of the invention is provided with position indicator means wherein the cap or plug 150 is of a color that contrasts with the remainder of the projectile, or that contrasts at least with the fuse end of the projectile, such that said contrasting coloration may be viewed through the substantially transparent or semi-transparent casing or through other visual observation means provided in the casing. Frequently, for example, the cardboard cylinder of the projectile may be made up of rolled layers of heavy paper having a rather dark red coloration, and the projectile fuse material is generally black in color. The red coloration of the projectile tube and the black coloration of the fuse 130 contrast well with an end cap 150 that is white, for example. Thus, even looking through the distorted or fogged crimped outer end of the casing, one may readily determine whether the fuse end or the cap end of the projectile is positioned adjacent the outer end of the casing. Other colors may, of course, be employed so long as the contrast between the fuse end and the cap end of the projectile are easily distinguishable through the substantially transparent or semi-transparent closed outer end of the casing when one or a group of aerial bombs are observed such as, for example, during the packaging of the devices.

It should be noted that visual observation means may be provided in the casing other than that described above and further that other indicator means may be provided on the projectile. Examples of such alternate embodiments of the invention include, but are not limited to, a contrasting stripe or other marking near one end of the projectile that is visible through the side wall of a substantially transparent or semi-transparent casing, or through an opening or a transparent portion in an otherwise relatively opaque casing, for providing visual observation of markings or other indication on the projectile. One skilled in the art will be able to readily derive various other alternate embodiments from the above description of the preferred and exemplary embodiments of the invention.

In use, the aerial bomb of the present invention is loaded into a conventional shotgun and the trigger is pulled to cause the firing pin of the gun to strike the shotgun primer 60. The primer ignites the propellant powder 80, producing flame or hot gases which flow through the hole 100 in the wad 90 to ignite the fuse 130 on the projectile 110 and to expel the projectile from the shotgun barrel. Due to the fact that the wad is in continuous peripheral contact with the adjacent inner surface of the shotgun shell hull, virtually all of the hot gases are directed through the hole 100 in the wad 90 to ignite the projectile fuse 130 located adjacent the hole 100. The expelled projectile explodes after a predetermined time delay during its flight. The duration of the time delay period is determined by factors such as volume of the fuse material, the burning rate of the fuse material, for example. A time delay of approximately 75 yards or 1.5 seconds has been found to be satisfactory.

The present invention thereby has as one of its advantages the fact that it is relatively simple in construction compared to many of the prior art devices which contain more parts. Another advantage of the aerial bomb of the present invention is that since the fuse on the projectile is completely contained within the projectile tube, it may be uniformly and reproducibly manufactured and presents little, if any, chance of being damaged in assembly, thereby assuring uniform firing. It may also be safely stored without undue fears of self-detonation or the like. An additional advantage is found in the preferred reversible wad, which in addition to greatly simplifying manual production, makes automatic production of applicant's invention a viable alternative.

Another of the advantages of the aerial bomb of the present invention is that it can be used in all types of cartridges, both shotgun-type and other types. This is due to the fact that the unique construction of applicant's invention is easily adaptable to various cartridge configurations. In addition, the present invention may be adapted for either center and rim fire detonation. Also, since the projectile of the present invention is significantly smaller than the barrel through which it is being propelled, any chances of dangerous pressure build-up or other such barrel obstructions are virtually eliminated. Any wads that lodge in the barrel are readily blown clear by the next cartridge. An additional feature of the present invention is that the projectile can be made to show a colored flare in addition to the explosion.

One of the principal advantages of the present invention is that the assembled aerial bombs may be quickly, conveniently and easily inspected, either individually or in a group, by mere visual observation to determine whether their projectiles have been installed in their casings in the proper orientation so that the projectile will explode after being expelled from a shotgun.

The foregoing discussion discloses and describes merely exemplary embodiments of the present invention. One skilled in the art will readily recognize from such discussion that various changes, modifications and variations may be made therein without departing from the spirit and scope of the invention as defined in the following claims.

I claim:

1. A delayed-exploding aerial bomb for use in a shotgun comprising:

(a) an elongated generally hollow cylindrical shotgun shell casing having at least a portion thereof composed of a substantially transparent material;

(b) a flanged base for said shotgun shell casing enclosing one end thereof, said base including a shotshell primer and an annular plug surrounding said primer;

(c) an ignitable propellant powder charge inside said shotgun shell casing generally adjacent said flanged base and in contact with both said shotshell primer and said annular plug;

(d) a symmetrical generally disc-shaped annular wad inside said shotgun shell casing generally adjacent said propellant powder charge, said wad having an empty opening extending therethrough generally in a longitudinal direction relative to said shotgun shell casing, said wad further being reversibly insertable into said shotgun shell casing and being of a diameter so as to maintain a continuous peripheral sealing contact with the adjacent inner surface of said shotgun shell casing in either of its reversibly inserted orientations therein;

(e) a projectile inside said shotgun shell casing with no physical contact between said projectile and said propellant powder charge, said projectile including a generally hollow cylindrical tube having two open ends and being of a uniform diameter substantially less than the inner diameter of said shotgun shell casing so as to prevent continuous peripheral contact between said tube and said casing, said projectile further including ignitable fuse means at one open end of said tube an ignitable explosive charge within said tube, and a closure cap sealingly disposed at the other open end of said tube, said fuse means including a mass of compacted black powder disposed within said tube adjacent said one open end of said tube and extending longitudinally only inwardly from said one open end such that said compacted black powder is spaced from said propellant powder charge, at least a portion of said closure cap having a color that substantially contrasts with the compacted black powder end of said charge end of said projectile, said explosive charge being disposed within said tube between said closure cap and said fuse means, said one open end and said opening in said wad being adjacent one another and providing communication between said propellant powder charge and said compacted black powder when said tube is properly oriented within said shotgun shell casing in order to allow a quantity of hot gases to flow through said opening in said wad and to ignite said compacted black powder when said propellant powder charge is ignited; and (f) said shotgun shell casing further including releasable closure means at the end of said shotgun shell casing opposite said base, at least said closure means including said substantially transparent portion of said shotgun shell casing in order to permit visual observation of said closure cap to determine whether said projectile has been properly oriented inside said casing with said fuse means generally adjacent said wad.

* * * * *